United States Patent [19]

Toliusis

[11] 4,242,946

[45] Jan. 6, 1981

[54] FLUID PRESSURE CYLINDER CONVERTIBLE FOR USE WITH OR WITHOUT INTERNAL BUMPERS

[75] Inventor: Vytautas J. Toliusis, Paw Paw Township, Van Buren County, Mich.

[73] Assignee: Humphrey Products Company, Kalamazoo, Mich.

[21] Appl. No.: 930,422

[22] Filed: Aug. 2, 1978

[51] Int. Cl.[3] ..... F01B 11/02; F01B 29/04

[52] U.S. Cl. ..... 92/59; 91/394; 92/85 R

[58] Field of Search ..... 92/59, 85 R, 13.41, 92/128; 91/54, 394, 396, 395

[56] References Cited

U.S. PATENT DOCUMENTS

| | | | |
|---|---|---|---|
| 1,294,023 | 2/1919 | Arbuckle | 92/59 |
| 2,976,844 | 3/1961 | Goldring | 92/59 X |
| 3,072,104 | 1/1963 | Marsh | 91/394 |
| 3,913,460 | 10/1975 | Wright | 92/85 R |

*Primary Examiner*—Irwin C. Cohen

*Attorney, Agent, or Firm*—Blanchard, Flynn, Thiel, Boutell & Tanis

[57] ABSTRACT

A fluid pressure cylinder which utilizes a standardized housing, piston and piston rod for forming a cylinder assembly either with or without bumpers. The bumpers can optionally be positioned on the piston when desired, with the overall assembled length and maximum stroke of the cylinder being identical whether provided with or without bumpers. The piston is selectively mounted on the piston rod in one axial orientation if bumpers are not used, and the piston is reversed and mounted on the piston rod in the opposite axial orientation when bumpers are used.

26 Claims, 9 Drawing Figures

FLUID PRESSURE CYLINDER CONVERTIBLE FOR USE WITH OR WITHOUT INTERNAL BUMPERS

FIELD OF THE INVENTION

This invention relates to a fluid pressure cylinder having an improved piston which can be utilized either with or without bumpers by axially reversing the piston relative to the housing while maintaining the remainder of the cylinder, including its stroke, the same.

BACKGROUND OF THE INVENTION

Small pneumatic cylinders are utilized in many industries for performing and controlling numerous operations. These pneumatic cylinders are conventionally of relatively small diameter, such as 2½ inches or less. Since these cylinders are often used for controlling a specific operation, such that the control and performance of this operation in an accurate manner is the most critical feature, relatively small cylinders can thus be successfully utilized.

At the present time, many of the utilized pneumatic cylinders are of the nonbumpered type, that is, the piston does not have any bumpers thereon so that the piston thus impacts against one or both end caps of the cylinder housing during the reciprocating movement thereof. This produces a hammering action which often emits an undesirably loud noise. This hammering action can be particularly severe and undesirable in those situations where the cylinder is repetitively cycled at a relatively rapid rate. The noise emitted by the hammering of the piston on the cylinder housing is obviously annoying, and can create a possible health hazard, to any personnel who may be working in the immediate vicinity.

In view of the noise associated with such nonbumpered cylinders, an increasing number of users of such cylinders now require that the cylinders have resilient bumpers for preventing the metal-to-metal contact between the piston and the cylinder end caps. While many bumpered cylinders are presently available, nevertheless these known bumpered cylinders create additional disadvantages.

Specifically, when bumpers are added to the cylinder, then this results in the length of the piston being increased when the bumpers are mounted thereon, or conversely results in the internal length of the cylinder housing being decreased when the bumpers are mounted on the end caps. The presence of the bumpers thus causes the cylinder stroke to be reduced in contrast to the stroke of an equivalent nonbumpered cylinder. Accordingly, to provide the bumpered cylinder with a stroke equal to that of a nonbumpered cylinder, it is necessary to utilize different components in the manufacture of the bumpered and nonbumpered cylinders so as to result in the same stroke. For example, if identical pistons are utilized, then a bumpered cylinder requires the use of a longer housing sleeve and a longer piston rod in order to result in the same stroke length as an equivalent nonbumpered cylinder. Alternately, pistons of different length may be used for bumpered and nonbumpered cylinders to enable use of the same housing. These possibilities are obviously undesirable since the manufacturer must thus stock different sizes of components, specifically rods and housing or pistons, in order to provide finished cylinder assemblies either with or without bumpers while having the same stroke.

A further disadvantage of this structure is that the completed bumpered cylinder assembly has an overall length which is slightly greater than the overall length of a nonbumpered cylinder assembly of the same stroke. This creates a significant problem for users who wish to replace an existing nonbumpered cylinder with a bumpered cylinder of the same stroke length, or vice versa, since the difference in the overall length of the bumpered and nonbumpered cylinder assemblies (for the same stroke) thus requires that the cylinder mounting structure be modified to accommodate the different length cylinder. In many situations, modifying the mounting so as to accommodate the different length cylinder is a laborious and time consuming, and hence expensive, operation.

Accordingly, it is an object of the present invention to provide an improved fluid pressure cylinder, and in particular a small diameter pneumatic cylinder, which can be manufactured either as a bumpered or nonbumpered cylinder while effectively overcoming the disadvantages mentioned above. More specifically, it is an object of this invention to provide an improved cylinder which utilizes standardized or universal parts so as to permit the cylinder to be provided with or without bumpers, with the resulting assembled cylinder whether provided with or without bumpers (1) being of the same overall length and possessing the same stroke and (2) having a physical size that is smaller or the same as comparable and equivalent nonbumpered cylinder.

Another object of this invention is to provide an improved fluid pressure cylinder, as aforesaid, which utilizes a standardized housing, piston and piston rod for forming a cylinder either with or without bumpers, which bumpers can optionally be positioned on the piston when desired, with the overall assembled length and piston stroke of the cylinder being identical whether provided with or without bumpers. In accomplishing this object, the piston is selectively mounted on the piston rod in one axial orientation if bumpers are not being utilized, and the piston is reversed and mounted on the piston rod in the opposite axial orientation when bumpers are being utilized.

A further object of the present invention is to provide an improved cylinder, as aforesaid, which provides different cooperating pairs of stops between the piston and the housing, depending upon whether the cylinder is of the bumpered or nonbumpered type, so as to permit the same identical housing structure to be utilized for both bumpered and nonbumpered operations while still maintaining the same stroke length for the piston.

Still a further object of this invention is to provide an improved cylinder, as aforesaid, which permits the use of a minimum number of different components for manufacturing both bumpered and nonbumpered cylinders, and which permits the users of such cylinders to readily interchange bumpered cylinders for nonbumpered cylinders, and vice versa, without effecting the desired stroke length and without requiring the cylinder mounting structure to be modified.

Another object of this invention is to provide an improved cylinder, as aforesaid, which provides the added option of permitting a permanent magnet to be easily mounted on the piston so as to cooperate with an external proximity switch to thereby readily indicate piston position, without requiring any substantial modification or rearrangement of the pressure cylinder while still retaining complete standardization of cylinder components and without affecting the desired stroke length.

Other objects and purposes of the invention will be apparent from reading the following description and inspecting the accompanying drawings.

BRIEF DESCRIPTION OF THE DRAWINGS

FIGS. 1 and 2 are central sectional views of a single-acting cylinder according to the present invention, wherein FIG. 1 illustrates the cylinder incorporating a bumper and FIG. 2 illustrates the same cylinder without the bumper.

FIGS. 7 and 8 are central cross-sectional views of a double-acting cylinder, wherein FIG. 7 illustrates the cylinder incorporating bumpers and FIG. 8 illustrates the same cylinder without bumpers.

Figure 1:
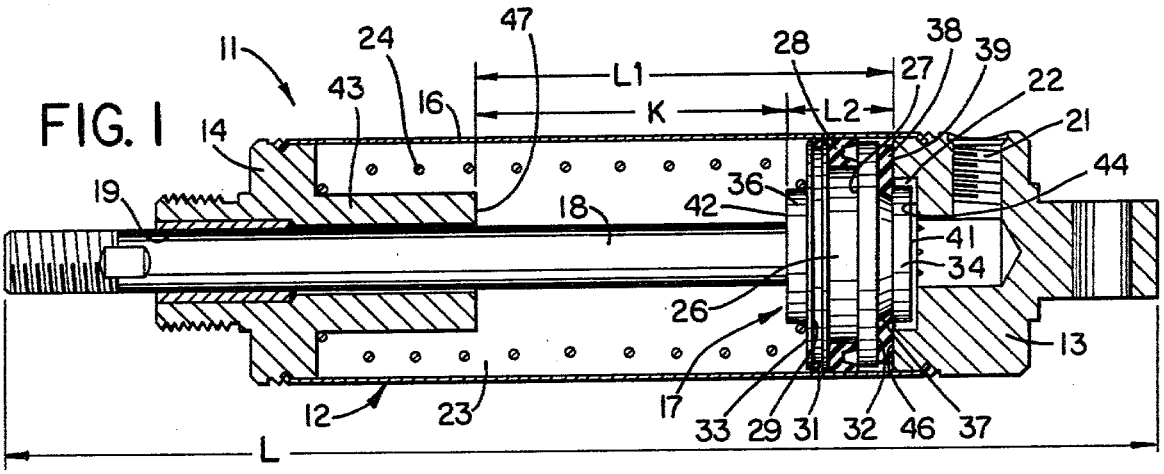

Certain terminology will be used in the following description for convenience in reference only and will not be limiting. For example, the words "upwardly", "downwardly", "leftwardly" and "rightwardly" will refer to directions in the drawings to which reference is made. The words "inwardly" and "outwardly" will refer to directions toward and away from, respectively, the geometric center of the cylinder and designated parts thereof. Said terminology will include the words specifically mentioned, derivatives thereof and words of similar import.

DETAILED DESCRIPTION

FIG. 1 illustrates a fluid pressure cylinder 11, particularly a miniature pneumatic cylinder, which is of the single-acting type. This cylinder includes a housing 12 formed by spaced end members 13 and 14 rigidly connected together by an elongated sleeve 16. A cylindrical piston 17 is slidably and sealingly supported within the sleeve 16 and is fixedly connected to an elongated rod 18 which slidably projects outwardly through a bore 19 formed in the end cap 14. A port 21 is formed in the opposite end cap 13 for permitting pressure fluid, such as air, to be supplied to or discharged from a chamber 22 which is defined between the piston 17 and the end cap 13. A further chamber 23 is defined on the opposite axial side of the piston, and a spring 24 is positioned within this chamber and extends between the end cap 14 and the piston 17 for normally urging the piston into an end position adjacent the end cap 13.

The piston 17 includes an enlarged-diameter central portion 26 having an annular groove 27 extending therearound for confining a conventional U-shaped elastomeric seal ring 28 which is disposed in sliding and sealing engagement with the interior of sleeve 16. A further annular groove 29 surrounds the central piston portion and confines therein an annular wear strip 31 (use of which is optional) which also slidably engages the sleeve 16. This central piston portion 26 terminates in opposite axially directed end faces 32 and 33.

Piston 17 also includes reduced-diameter cylindrical end portions 34 and 36 which project axially outwardly from the respective end faces 32 and 33. These end portions are of the same diameter, and are adapted to function as a seat for receiving one end of the spring 24. The one end portion 34 has an annular groove 37 formed therein and spaced axially inwardly from the free end thereof. This annular groove 37 confines therein the radially inner edge of an annular bumper 38, which bumper is constructed of a resilient material and is formed substantially as a flat ringlike washer. The bumper 38 projects radially outwardly so as to have an outer diameter slightly less than that of the central piston portion, whereby the bumper thus overlies the end surface 32. The bumper has an exposed axially-directed side surface 39.

The piston end portions 34 and 36 define, at their free ends, axially directed stop faces 41 and 42, respectively. One of these end portions, depending upon the axial orientation of the piston, is adapted to project into an annular recess 44 which is formed centrally of the end cap 13.

To limit the reciprocating movement of piston 17, the housing 12 has a first annular stop face 46 formed on the inner axial end of the cup-shaped end cap 13, which stop face 46 is in surrounding relationship to the recess 44. A further annular stop face 47 is formed on the inner axial end of a reduced diameter hub portion 43 which is integral with the end cap 14 and projects axially inwardly in surrounding relationship to the piston rod. This hub 43 has an outside diameter substantially equal to that of the piston end portions 34 and 36, whereby the housing stop face 47 is thus radially spaced inwardly from the housing stop face 46.

Figure 3:
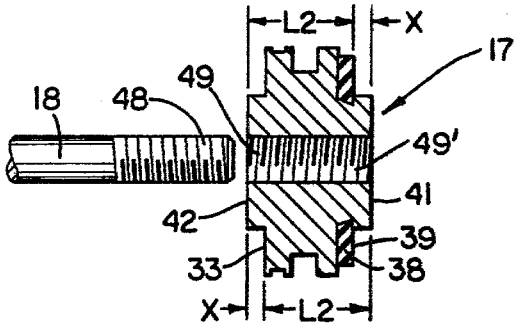
FIG. 3 is an exploded, fragmentary view, partially in cross section, illustrating one connection between the piston and piston rod.

To fixedly connect the piston 17 to the rod 18, there is provided a connecting structure which, as illustrated in FIG. 3, permits the piston to be connected to the rod in opposite axial orientations. For this purpose, the piston rod is provided with a threaded part 48 at the free end thereof, and the piston 17 is provided with a pair of substantially identical threaded portions 49 and 49' extending axially inwardly from the opposite axial ends thereof, which portions define a single bore having a continuous thread therethrough.

Figure 2:
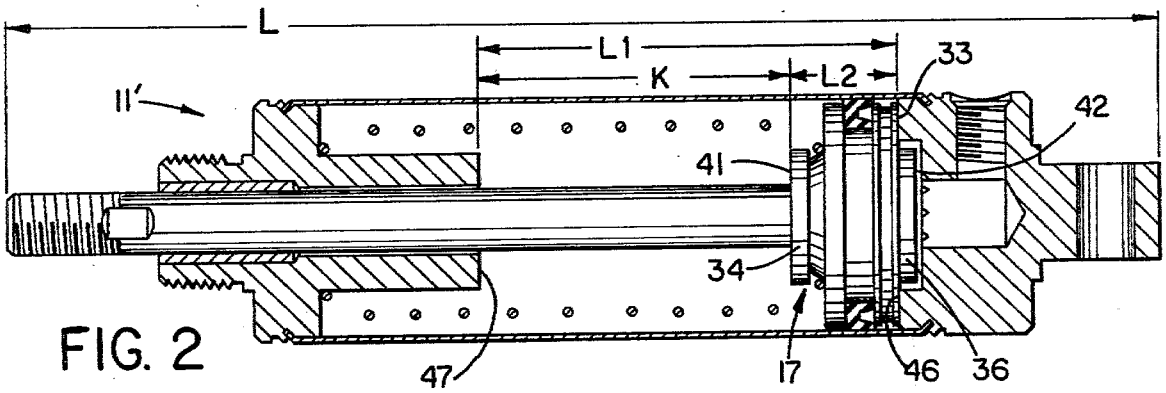

When the piston is connected to the piston rod in the orientation illustrated in FIG. 1, then threaded part 48 is engaged with the threaded portion 49. On the other hand, if the piston is turned end-for-end so as to be in the opposite axial orientation as illustrated in FIG. 2, then the threaded part 48 is engaged with the threaded portion 49'.

OPERATION

When a single-acting fluid pressure cylinder employing a bumper is desired, then piston 17 is assembled to piston rod 18 as illustrated in FIG. 1. Supplying of pressure fluid through port 21 into chamber 22 causes the piston to move leftwardly until the end surface 42 contacts the housing stop surface 47, thereby defining the leftward end position of the piston. When the pressure fluid is permitted to discharge from chamber 22, then spring 24 urges the piston into its rightward end postion wherein the side surface 39 on bumper 38 contacts the housing stop surface 46. This contact between the housing and the bumper substantially eliminates any hammering or noise due to the spring-urged return of the piston against the end cap 13.

The pressure cylinder 11 of FIG. 1 has an effective stroke K as measured between surfaces 42 and 47, with preselected axial spacing L1 existing between the housing stop surfaces 46 and 47.

If use of a bumper on the piston is not desired, then the piston 17 can be axially turned end-for-end and mounted on the rod 18 in a reverse axial orientation. In this situation, the threaded part 48 of the piston rod is engaged with the threaded portion 49' so that the piston 17 is thus axially reversely oriented relative to the piston rod and the housing, as illustrated by the cylinder 11' of FIG. 2. In this situation, the bumper 38 can be eliminated from the piston if desired. In all other respects, however, the piston and housing of cylinder 11' (FIG. 2) are identical to the piston and housing of the cylinder 11 (FIG. 1). In this reverse axial orientation of the piston as shown in FIG. 2, the opposite piston end surface 41 is now positioned for abutting engagement with the housing stop surface 47. At the other end of the piston, the end surface 33 is now normally maintained in abutting engagement with the housing stop surface 46. The piston still has the same preselected stroke K as measured by the axial spacing between the surfaces 41 and 47, and the housing has the same preselected axial distance L1 separating the surfaces 46 and 47. Further, the cylinders 11 and 11' both have the same overall contracted length L while utilizing the same end caps 13 and 14, the same housing sleeve 16, the same piston rod 18 and the same basic piston 17.

The above relationships are achieved in this embodiment of the invention by forming the piston, and its connection to the piston rod, with the relationships illustrated in FIG. 3. That is, the cooperating stop or abutment faces 39 and 42 which are effective when the piston is oriented as illustrated in FIG. 1 are separated by a distance L2. The projecting portion of the piston end portion 41 has a length X. Similarly, the axial distance between the other pair of cooperating stop surfaces 33 and 41, which surfaces are operative when the piston is oriented as illustrated in FIG. 2, is also L2, with the end portion 42 projecting outwardly from the surface 33 by the distance X. This structure of the piston, its cooperation with the stop surfaces 46 and 47 on the housing and the relationship between the threaded piston part 48 and the identical threaded piston portions 49 and 49', thus permits the identical basic piston 17 to be mounted in reverse axial orientations with respect to the piston rod, and utilized with the same identical housing 12, while still providing the same basic piston stroke K whether the piston is provided with or without a bumper as shown in FIGS. 1 and 2, respectively.

MODIFICATIONS

Figure 4:
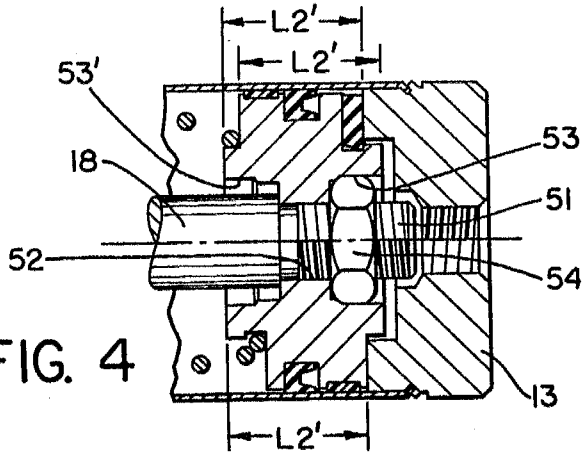
FIG. 4 is a fragmentary sectional view illustrating another connection between the piston and piston rod.

FIG. 4 illustrates a modified structure for rigidly connecting the piston 17 to the rod 18. The rod again includes a threaded part 51 at the free end thereof. A through bore 52 extends coaxially through the piston, which bore terminates in enlarged bores 53 and 53' at the opposite ends thereof. These bores are substantially symmetrical about the midpoint of the piston. A nut 54 is fixedly positioned within one of these bores, as by means of an interference fit, and is threadedly engaged with the threaded rod part 51. When piston 17 is mounted on rod 18 in the axial orientation illustrated in FIG. 1, and as illustrated by the top half of FIG. 4, then nut 54 is positioned within the bore 53. On the other hand, when the piston is mounted on the rod in the reverse axial orientation illustrated in FIG. 2, and as illustrated by the lower part of FIG. 4, then the nut 54 is positioned within the opposite bore 53'.

Figure 5:
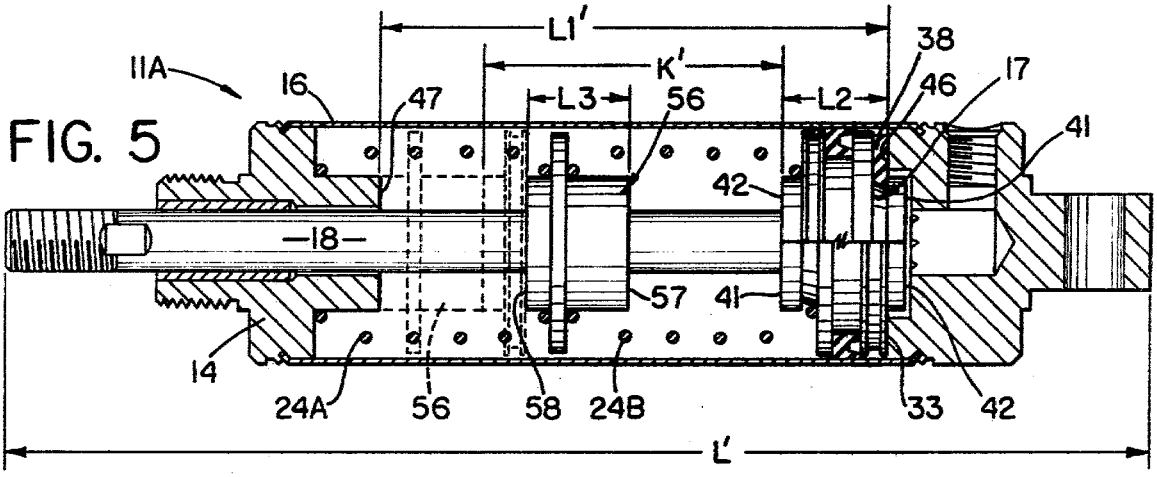
FIG. 5 is a sectional view illustrating a variation of the single-acting cylinder.

FIG. 5 illustrates a modified single-acting fluid pressure cylinder 11A, having a substantially greater stroke length, and which necessitates the use of a longer housing sleeve 16. The piston structure in this embodiment again utilizes the same piston 17 fixed to the end of rod 18, which piston 17 functions as a primary piston. The piston structure also includes a secondary piston 56 which is of a cylindrical construction and is disposed in surrounding relationship to and slidably supported relative to the rod 18. This secondary piston 56 has annular contact surfaces 57 and 58 formed on the opposite axial ends thereof. Surface 58 is disposed to contact the housing stop surface 47, whereas the opposite end surface 57 is disposed to contact one of the end surfaces 41 or 42 depending upon the axial orientation of the primary piston 17. This secondary piston 56 is provided so as to permit the use of two springs 24A and 24B, which springs have their adjacent ends supported on the secondary piston 56 so as to prevent compression of the springs into a solid condition.

The cylinder 11A of FIG. 5 operates in the same manner as the cylinder 11 of FIG. 1 except that cylinder 11A is designed to permit a longer piston stroke. When the piston 11A is operating with a bumper 38 on the piston 17, as illustrated by the top half of the piston in FIG. 5, then the piston end surface 42 contacts the secondary piston end surface 57, and the opposite end surface 58 of the secondary piston abuts the housing stop surface 47 for defining the leftward limit position of the piston. However, when a bumpered piston is not desired, then the primary piston 17 is mounted on the rod in the reverse axial orientation as illustrated by the lower part of the piston in FIG. 5, whereby end surface 41 is now disposed for contacting the surface 57. Irresepective of the axial orientation of the piston 17, the cylinder 11A uses the same identical housing, the same piston and the same piston rod, thus resulting in the same identical piston stroke K' and overall length L' whether provided with or without the bumper 38.

Figure 6:
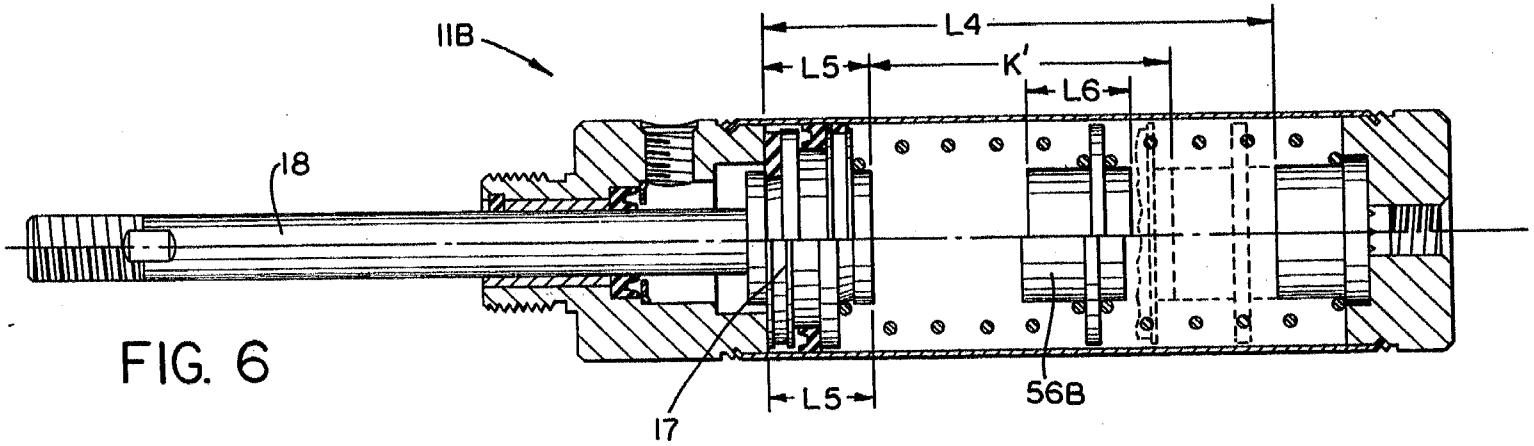
FIG. 6 is similar to FIG. 5 but illustrates a further variation of the single-acting cylinder.

FIG. 6 illustrates still a further variation of a fluid pressure cylinder 11B which is of the "pull" type, in contrast to the "push" type cylinder 11A of FIG. 5. The cylinder 11B is again provided with a secondary piston 56B for supporting the adjacent ends of aligned compression springs so as to permit the spring-returned piston to have a stroke of substantial length. In the cylinder 11B, the primary piston 17 can again be provided with or without the bumper 38 merely by reversing the primary piston 17 end-for-end relative to the piston rod and housing. Whether provided with a bumper as shown in the top part of FIG. 6, or without the bumper as shown in the bottom part of FIG. 6, the cylinder 11B still has the same identical piston stroke K' and overall length while utilizing the same housing structure, the same piston rod and the same basic piston 17.

In comparing the cylinder of FIGS. 1 and 2 with those of FIGS. 5 and 6, it will be appreciated that cylinders having a very short stroke length will permit the use of a single spring for returning the piston, so that the use of a secondary piston such as 56 or 56B is not required. However, as the stroke length increases, then the number of springs which are disposed in series will increase somewhat in proportion to the increase in stroke length, with the number of secondary pistons always being one less than the number of springs. This arrangement prevents the springs from being compressed to a solid condition, and also prevents excessive droop of the springs.

Figure 7:
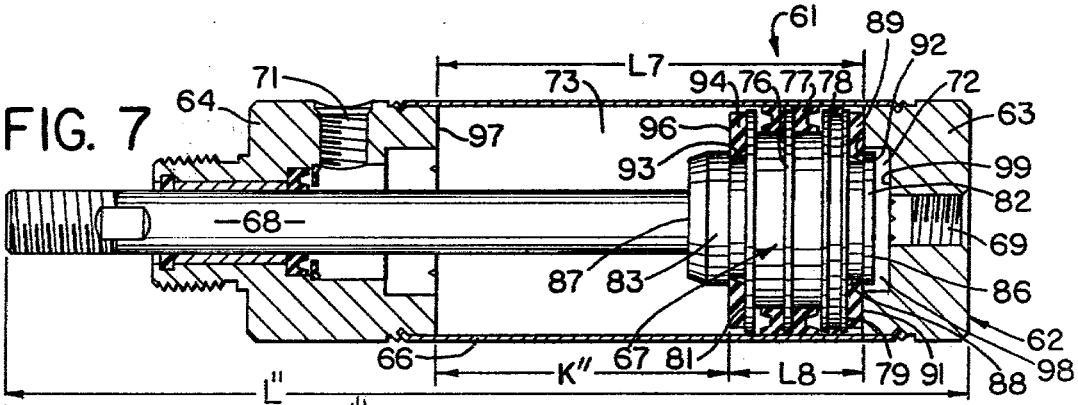

While the present invention has been described above with respect to several embodiments of a single-acting cylinder, this invention is also applicable to a double-acting fluid pressure cylinder, such as cylinder 61 of FIG. 7.

The cylinder 61 is of the same basic structure in that it includes a housing 62 formed by cup-shaped end caps 63 and 64 rigidly joined together by an intermediate sleeve 66. A cylindrical piston 67 is slidingly and sealingly supported within the sleeve and is rigidly connected to a piston rod 68 which projects outwardly through at least one of the end caps. Ports 69 and 71 are formed in the end caps for permitting pressure fluid to be supplied to or discharged from the chambers 72 and 73, respectively, as defined on axially opposite sides of the piston.

The piston 67 includes an enlarged-diameter central portion 76 provided with a pair of surrounding grooves in which are positioned conventional elastomeric cup seals 77, and provided with a further surrounding groove in which may be positioned an annular wear strip 78. This central portion 76 terminates in opposite, axially-directed end faces 79 and 81.

The piston also includes reduced-diameter cylindrical end portions 82 and 83 which project axially outwardly from the end faces 79 and 81, respectively. The end portions 82 and 83, which are of the same outside diameter, terminate in axially directed end faces 86 and 87, respectively.

The one end portion 82 has an annular groove 88 therearound in which is seated the radially inner edge of an annular bumper 89, which bumper overlies the end face 79 and is provided with an exposed side surface 91 which is adapted to be moved into abutting engagement with an annular stop surface 92 formed on the end cap 63.

The other piston end portion 83 also has a surrounding annular groove 93 formed therein for confining the radially inner edge of a further annular bumper 94. This bumper 94 overlies the other end surface 81, and has an exposed side surface 96 positioned for abutting engagement with a further annular stop surface 97 formed on the opposite end cap 64.

The one end cap 63 has a central recess 98 formed axially therein, which recess is of a diameter slightly greater than that of the piston end portions 82 and 83. This recess 98 terminates at a bottom wall 99.

When the double-acting cylinder 61 is provided with bumpers 89 and 94 on the piston, then the bumper side surfaces 91 and 96 are adapted to abuttingly contact the housing stop surfaces 92 and 97, respectively. This provides the piston with a preselected stroke length K", which stroke length is equal to the axial distance L7 between the housing stop surfaces 92 and 97 minus the axial distance L8 between the bumper side surfaces 91 and 96.

Figure 8:
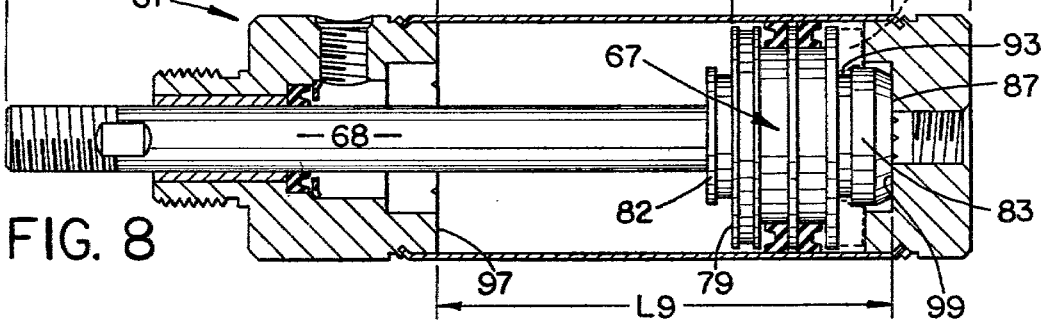

When bumpers are not desired, then they can be eliminated from the piston so as to provide a cylinder 61' as shown in FIG. 8. In addition to elimination of the bumpers, the piston is also turned end-for-end so as to be reversely axially oriented relative to the piston rod 68 and the housing 62. In this situation, the stop surface 87 formed at one end of the piston is adapted to contact the bottom wall 99 on the end cap for defining one limit position of the piston, and the end wall 79 of the piston is adapted to contact the housing stop surface 97 for defining the other limit position of the piston. The piston 67' again has the same preselected stroke length K" which is equal to the overall axial spacing L9 between housing stop surfaces 97 and 99 minus the axial distance L10 between the piston stop surfaces 79 and 87.

While the cylinders 61 and 61' thus utilize the same identical housing 62, the same piston rod 68 and the same basic piston 67, nevertheless the piston can be provided with or without bumpers. By axially reversing the orientation of the piston relative to the piston rod, the resultant cylinder 61 or 61' thus not only has the same identical piston stroke K" but also has the same overall contracted length L".

The connection between piston 67 and rod 68 may assume several different forms, for example is illustrated in FIG. 3 or FIG. 4, which connection permits the rod to be axially connected to the piston in two axially opposite orientations to permit both the overall cylinder length L" and piston stroke K" to be preserved whether the cylinder is assembled for use with or without bumpers.

The piston 17 or 67 of the present invention also permits same to be utilized either with or without the wear strip 31 or 78.

In all of the disclosed embodiments, it will be observed that the piston is axially nonsymmetrical so as to permit the piston to be reversely axially oriented while defining different pairs of stop surfaces to thereby maintain a fixed piston stroke.

Figure 9:
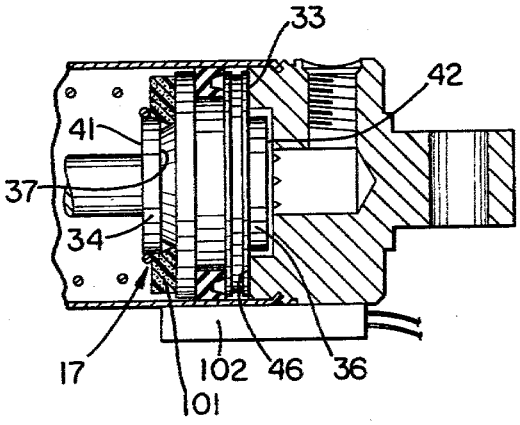
FIG. 9 is a fragmentary sectional view of another modification.

The improved pressure cylinder of this invention, as described above with reference to FIGS. 1–8, offers still a further advantageous adaptation while still retaining complete standardization with respect to the basic components, such as the piston, piston rod and housing, without affecting the stroke length. More specifically, this improved pressure cylinder can be easily adapted for use in activating a proximity switch when the piston is in its normal extreme position, or at any other selected position, to thereby provide an appropriate electrical signal which can be utilized for control or other purposes. Referring to FIG. 9, there is illustrated the same basic structure illustrated on the right side of FIG. 2, wherein the cylinder is utilized without bumpers on the piston. In this case, the piston 17 can have an annular switch-activating washer 101 snapped over and into the groove 37 (which groove receives therein the bumper when the cylinder is assembled as shown in FIG. 1). This washer 101 is constructed of a flexible binder material such as rubber or plastic which is impregnated with ferrite particles so that the washer 101 thus functions as a permanent magnet, while still being soft and pliable. The permanent magnet defined by washer 101, when the piston is in its normal retracted position, can cause activation of a conventional reed switch 102 which is secured to the cylinder housing exteriorly thereof. This reed switch, which can be either normally open or normally closed, thus signals when the piston is in close proximity to its normal retracted position. The washer 101 can, if desired, have a thin nonmagnetic washer (not shown), such as of stainless steel, disposed over the exposed face thereof so as to function as a seat for the spring 24.

The addition of a permanent magnet to the piston, as illustrated in FIG. 9 with reference to the pressure cylinder shown in FIG. 2, is also applicable to the cylinders shown in FIGS. 5 and 6. For example, the washerlike permanent magnet could be snapped over and into the groove 37 when the piston is oriented as illustrated in the bottom half of FIGS. 5 and 6. A washerlike permanent magnet 101 could also be added to the pressure cylinder of FIG. 8, the washer being snapped over and into the normal bumper-receiving groove 93 substantially as indicated by dotted lines in FIG. 8.

Thus, the same basic pressure cylinder of this invention can optionally have a permanent magnet thereon for actuating a proximity switch in response to the piston position, without requiring any modification or rearrangement of the overall pressure cylinder.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or priviledge is claimed are defined as follows:

1. In a fluid pressure cylinder having an identical preselected piston stroke whether provided with or without resilient bumpers, said cylinder including a housing having spaced end caps fixedly connected by a sleeve, piston means slidably and sealingly engaged with the interior of said sleeve for reciprocating movement relative to said housing between first and second end postions disposed adjacent said first and second end caps respectively, and a piston rod fixed to said piston means and slidably projecting outwardly through at least one of said end caps, the improvement comprising:

said piston being axially nonsymmetrical and selectively axially oriented in one axial orientation or the other, relative to said housing, so as to be respectively used with or without resilient bumpers;

connecting means for fixedly joining said piston means to said piston rod in either axial orientation of said piston means relative to said housing, said connecting means including first means on said rod engageable with second means on said piston means;

first stop means cooperating between said first end cap and said piston means for defining said first position when said piston means is in said one axial orientation relative to said housing, said first stop means including a first rigid axially-facing stop surface on said first end cap and adapted for engagement with a second axially-facing stop surface on said piston means adjacent one end thereof;

second stop means cooperating between said second end cap and said piston means for defining said second position when said piston means is in said one axial orientation, said second stop means including a third rigid axially-facing stop surface on said second end cap and adapted for engagement with a fourth resilient axially-facing stop surface on said piston means adjacent the other end thereof;

third stop means cooperating between said first end cap and said piston means for defining said first position when said piston means is in said opposite axial orientation relative to said housing, said third stop means including a fifth rigid axially-facing stop surface on said piston means adjacent said other end thereof and adapted for engagement with said first stop surface;

fourth stop means cooperating between said second end cap and said piston means for defining said second position when said piston means is in said opposite axial orientation, said fourth stop means including a sixth rigid axially-facing stop surface on said piston means adjacent said one end thereof and adapted for engagement with said third stop surface;

said piston means being free of resilient bumper means when disposed in said opposite axial orientation;

said piston means including resilient bumper means mounted thereon when said piston means is disposed in said one axial orientation, said bumper means defining thereon said fourth stop surface with the latter being engaged with said third stop surface when the piston means is at one end of its stroke, the fifth stop surface on said piston means being spaced from and maintained out of engagement with said second end cap when the piston means is at said one end of the stroke;

the axial distance between said first stop surface and said third stop surface at its point of engagement with said fourth stop surface, minus the axial distance between said second and fourth stop surfaces, being equal to said preselected stroke of said piston means when the latter is in said one axial orientation; and the axial distance between said first stop surface and said third stop surface at its point of engagement with said sixth stop surface, minus the axial distance between said fifth and sixth stop surfaces, also being equal to said preselected stroke of said piston means when the latter is in said opposite axial orientation.

2. A cylinder according to claim 1, wherein said fifth and sixth stop surfaces are both axially and radially spaced apart.

3. A cylinder according to claim 2, wherein said first stop surface and at least a portion of said third stop surface are radially spaced apart.

4. A cylinder according to claim 1, wherein one of said end caps is of a cuplike configuration and includes an annular wall portion disposed in surrounding relationship to a central recess, said annular wall portion terminating in an exposed axially facing end wall defining one of said first and third stop surfaces, said central recess being in open communication with the interior of said housing, said piston means having a reduced-diameter end portion projecting axially at one end thereof and being adapted to project into said central recess, and the other end cap having a reduced diameter hub part formed centrally thereof and projecting axially into the interior of said housing, said hub part having a free end surface which defines the other of said first and third stop surfaces.

5. A cylinder according to claim 4, wherein said central aperture is formed in said second end cap and said central hub part is formed on said first end cap, said piston means having said reduced-diameter end portion disposed at said other end thereof and positioned for projecting into said central recess when said piston means is in said one axial orientation, said reduced-diameter end portion projecting axially outwardly beyond said bumper means, and said bumper means being positioned radially outwardly of and in surrounding relationship to said end portion.

6. A cylinder according to claim 5, wherein said piston means includes a central cylindrical portion of enlarged diameter disposed for sliding and sealing engagement with said sleeve, said reduced-diameter end portion projecting axially outwardly from one end of said central portion, and said piston means having a further reduced-diameter end portion projecting axially outwardly from the opposite end of said central portion, said central portion having an axially facing end wall which is adjacent but spaced axially inwardly from the free end of said further end portion, said end wall defining said sixth stop surface.

7. A cylinder according to claim 6, wherein the free end of said first-mentioned end portion defines said fifth stop surface, and wherein the free end of said further end portion defines said second stop surface.

8. A cylinder according to claim 7, including compression spring means positioned within said sleeve and coacting between said piston means and said first end cap for resiliently urging said piston means toward said second end position, and said spring means including intermediate annular support means movably positioned within said sleeve axially between said piston means and said first end cap, whereby movement of said piston means into said first position causes said support means to be engaged with and between said first stop surface and one of said second and fifth stop surfaces depending upon the axial orientation of said piston means.

9. A cylinder according to claim 7, wherein said second and fifth stop surfaces are both positioned for engaging the same part of said first stop surface, said fourth and sixth stop surfaces both being positioned for engaging the same part of said third stop surface, said second and fourth stop surfaces being axially spaced apart by a distance equal to the axial spacing between said fifth and sixth stop surfaces.

10. A cylinder according to claim 1, wherein said piston means includes second resilient bumper means mounted thereon adjacent said one end thereof, said second resilient bumper means defining said second stop surface.

11. A cylinder according to claim 10, wherein said piston means includes a reduced-diameter end portion projecting axially outwardly beyond the adjacent bumper means, said end portion having a free end surface which defines one of said fifth and sixth stop surfaces.

12. A cylinder according to claim 11, wherein said piston means includes an enlarged-diameter central portion disposed in slidable and sealed engagement with the sleeve, said piston means also including a second reduced-diameter end portion associated with the other end of said piston means and projecting axially outwardly beyond the other bumper means, each of said bumper means comprising an annular resilient element positioned radially outwardly of and in surrounding relationship to a respective one of said end portions and spaced axially inwardly from the axially outer end thereof.

13. A cylinder according to claim 12, wherein said central portion of said piston means has an axial end wall positioned adjacent said second end portion, said axial end wall being disposed in supporting engagement with the inner axial surface of the respective bumper means, said axial end wall defining the other of said fifth and sixth stop surfaces.

14. A cylinder according to claim 13, wherein each of said first and second end caps are of a cuplike configuration including an annular rim portion positioned around a central recess, the rim portions of said first and second end caps terminating in axially facing end surfaces, the end surface of said first end cap defining said first stop surface, the end surface of said second end cap defining a part of said third stop surface, and the central recess of said second end cap having a bottom wall which defines a further part of said third stop surface, the further part of said third stop surface being axially and radially displaced from the first-mentioned part, said further part of the third stop surface being positioned for engaging the sixth stop surface when the piston means is in said opposite axial orientation, and the first-mentioned part of said third stop surface being positioned for engaging said fourth stop surface when the piston means is in said one axial orientation.

15. In a fluid pressure cylinder having a housing defined by first and second spaced end caps fixedly connected by a sleeve, piston means slidably supported within said housing for reciprocating movement, and a piston rod fixed to said piston means and slidably projecting outwardly through at least one of said end caps, comprising the improvement wherein:

said housing including a set of rigid axially facing stop surfaces disposed interiorly thereof and positioned for cooperation with said piston means for limiting the reciprocating movement thereof, said set including first and second said stop surfaces formed on said first and second end caps respectively, said first and second stop surfaces being both axially and radially spaced apart;

said piston means being axially nonsymmetrical and including two pairs of oppositely and axially facing abutment surfaces, a first said pair of abutment surfaces being positioned for cooperation with said set of stop surfaces when said piston means is mounted on said rod in one axial orientation relative to said housing to define a maximum piston stroke of preselected length, at least one of the abutment surfaces of said first pair being resilient, and a second said pair of abutment surfaces positioned for cooperation with said set of stop surfaces when said piston means is mounted on said rod in an opposite axial orientation relative to said housing to define a maximum piston stroke of said preselected length, both of the abutment surfaces of said second pair being rigid;

said first pair including a first abutment surface disposed adjacent one end of said piston means and facing axially outwardly thereof, and a second abutment surface disposed adjacent the other end of said piston means and facing axially outwardly thereof, said first and second abutment surfaces being both axially and radially spaced apart;

said second pair including a first rigid abutment surface disposed adjacent said other end of said piston means and facing axially outwardly thereof, and a second rigid abutment surface disposed adjacent said one end of said piston means and facing axially outwardly thereof, said first and second abutment surfaces being both axially and radially spaced apart;

the first abutment surface of said first pair being axially adjacent but spaced radially inwardly from the second abutment surface of said second pair, and the second abutment surface of said first pair being axially adjacent but spaced radially outwardly of the first abutment surface of said second pair;

said piston means including resilient bumper means fixed thereto, said bumper means defining one of the abutment surfaces of said first pair; and connecting means for fixedly joining said piston means to said piston rod in either axial orientation of said piston means relative to said housing, said connecting means including first means on said rod engageable with second means on said piston means, said second means including substantially identical connecting portions disposed adjacent the opposite ends of said piston means, said first means being engageable with one of said connecting portions when said piston means is disposed in said one axial orientation relative to said housing, said first means being engageable with the other of said connecting portions when said piston means is disposed in said opposite axial orientation relative to said housing.

16. A cylinder according to claim 15, wherein said first stop surface is spaced radially outwardly of said second stop surface, said bumper means defining the second abutment surface of said first pair with said second abutment surface being spaced radially outwardly of the first abutment surface of said first pair, the second abutment surface of said first pair being spaced radially outwardly of the first abutment surfaces of said first pair, and the first abutment surface of said first pair being spaced radially inwardly from the second abutment surface of said second pair.

17. A cylinder according to claim 16, wherein the first abutment surfaces of said first and second pairs are defined at the opposite free ends of said piston means, the second abutment surfaces of said first and second pairs being spaced axially inwardly from the free ends of said piston means.

18. A cylinder according to claim 15, wherein said second stop surface is spaced radially outwardly of said first stop surface, said second end cap having an annular recess formed radially within said second stop surface and projecting axially therefrom, said piston means including reduced diameter portions adjacent the opposite ends thereof which are of a diameter less than said recess, said reduced diameter portions having exposed end surfaces which define two of said abutment surfaces.

19. A cylinder according to claim 15, wherein said piston means includes at least primary and secondary pistons movably disposed within said housing, said primary piston being fixed to said rod by said connecting means, said secondary piston being movably positioned between said primary piston and one of said end caps, first spring means coacting between said last-mentioned end cap and said secondary piston, second spring means coacting between said secondary piston and said primary piston, said secondary piston having a third pair of axially and oppositely facing abutment surfaces thereon, the surfaces of said third pair being defined by the opposite axial ends of said secondary piston so that one of the surfaces of said third pair is positioned for engagement with one of said stop surfaces and the other abutment surface of said third pair is positioned for engagement with one of the abutment surfaces of either said first pair or said second pair depending upon the axial orientation of the primary piston relative to the housing.

20. In a fluid pressure cylinder having a housing defined by first and second spaced end caps fixedly connected by a sleeve, piston means slidably supported within said housing for reciprocating movement, and a piston rod fixed to said piston means and slidably projecting outwardly through at least one of said end caps, the improvement comprising:

said piston being axially nonsymmetrical and selectively axially oriented in one axial orientation or the other, relative to said housing, so as to be respectively used with or without resilient bumpers;

said housing including a set of rigid axially facing stop surfaces disposed interiorly thereof and positioned for cooperation with said piston means for limiting the reciprocating movement thereof, said set including a first said stop surface formed on said first end cap, said set also including second and third said stop surfaces formed on said second end cap and axially facing said first stop surface, said second and third stop surfaces being both axially and radially spaced apart;

said piston means including two pairs of oppositely and axially facing abutment surfaces, a first said pair of abutment surfaces being positioned for cooperation with said first and second stop surfaces when said piston means is mounted on said rod in said one axial orientation relative to said housing to define a maximum piston stroke of preselected length, and a second said pair of abutment surfaces positioned for cooperation with said first and third stop surfaces when said piston means is mounted on said rod and in said opposite axial orientation relative to said housing to define a maximum piston stroke of said preselected length;

said first pair including a first resilient abutment surface disposed adjacent one end of said piston means and facing axially outwardly thereof, and a second resilient abutment surface disposed adjacent the other end of said piston means and facing axially outwardly thereof, said first and second abutment surfaces being axially spaced apart;

said second pair including a first rigid abutment surface disposed adjacent said other end of said piston means and facing axially outwardly thereof, and a second rigid abutment surface disposed adjacent said one end of said piston means and facing axially outwardly thereof, said first and second abutment surfaces being axially spaced apart;

the first abutment surface of said first pair being adjacent but axially spaced from the second abutment surface of said second pair, and the second abutment surface of said first pair being adjacent but axially spaced from the first abutment surface of said second pair;

said piston means including first and second resilient bumpers fixed thereto adjacent the opposite ends thereof, said first and second bumpers having exterior axial surfaces respectively defining the first and second resilient abutment surfaces of said first pair;

said piston means when mounted on said rod in said one axial orientation resulting in said first and second abutment surfaces of said first pair being respectively disposed for engagement with said first stop surface and one of said second and third stop surfaces for limiting the reciprocating movement thereof, said piston means absent said first and second bumpers being mountable on said rod in said opposite axial orientation whereby the first and second abutment surfaces of said second pair are respectively positioned for engaging said first stop surface and the other of said second and third stop surfaces for limiting the reciprocating movement thereof; and connecting means for fixedly joining said piston means to said piston rod in either axial orientation of said piston means relative to said housing, said connecting means including first means on said rod engageable with second means on said piston means.

21. A cylinder according to claim 20, wherein said second end cap has a central recess extending axially inwardly thereof, said second stop surface being defined in surrounding relationship to said recess, and said third stop surface being defined axially inwardly of said recess, said piston means including a reduced diameter portion at said one end thereof, said reduced diameter portion projecting axially outwardly beyond said first bumper, said reduced diameter portion having an end surface defining said second abutment surface of said second pair, said reduced diameter end portion being of smaller diameter than said recess so as to project into said recess and contact said third stop surface when said piston means is in said opposite axial orientation.

22. A cylinder according to claim 20, wherein said piston means has a further reduced diameter end portion disposed adjacent the other end thereof, said further end portion being of smaller diameter than said recess and being of substantially shorter axial length than said first-mentioned end portion so as to not contact said third stop surface when said piston means is in said one axial orientation.

23. A cylinder according to claim 20, wherein said piston means includes an enlarged center portion and a pair of reduced diameter end portions fixed to and projecting outwardly from opposite axial ends of said center portion, each of said end portions having an annular groove for confining one of said bumpers therein, said center portion having axial end walls which supportingly engage the axially inner surfaces of said bumpers, the end wall adjacent said other end of said piston means comprising the first abutment surface of said second pair.

24. A cylinder according to claim 23, wherein said reduced diameter end portion at said one end of said piston means includes a projecting portion which extends axially outwardly beyond the adjacent bumper, the exposed end surface of said projecting portion defining the second abutment surface of said second pair.

25. A cylinder according to claim 20, wherein the second means of said connecting means includes similar connecting portions disposed adjacent the opposite ends of said piston means, said first means being engageable with one of said connecting portions when said piston means is disposed in said one axial orientation relative to said housing, said first means being engageable with the other of said connecting portions when said piston means is disposed in said opposite axial orientation relative to said housing.

26. In a fluid pressure cylinder having a housing defined by first and second spaced end caps fixedly connected by a sleeve, piston means slidably supported within said housing for reciprocating movement between said end caps, and a piston rod fixed to said piston means and slidably projecting outwardly through at least one of said end caps, the improvement comprising:

said piston means including a rigid annular piston member which is axially nonsymmetrical and which has elastomeric seal ring means mounted thereon in surrounding relationship therewith for creating a slidable sealed engagement with the interior of said sleeve as the piston means is slidably moved within said housing;

said piston means being selectively axially oriented in one or the other axial orientation relative to said housing so as to be respectively used with or without resilient bumpers while still providing a stroke of the same predetermined magnitude;

connecting means for fixedly joining said piston means to said piston rod in either axial orientation of said piston means relative to said housing;

said piston member having defined therein first and second annular grooves disposed in encircling relationship thereto for permitting a resilient washer-like bumper to be mounted within each groove of said piston member, said first and second grooves being individually disposed adjacent the opposite axial ends of the piston member and being suitably axially spaced apart so that said elastomeric seal ring means is disposed axially therebetween;

said piston means, when disposed in one axial orientation relative to said housing, being provided with bumpers within said grooves defining thereon a first pair of stop surfaces positioned for individually abutting the end caps for limiting the stroke of said piston means to a predetermined magnitude, the first pair of stop surfaces including a first axially outwardly facing surface formed on the exposed side of one bumper and a second axially outwardly facing surface formed on the exposed side of the other bumper;

said piston member, when said piston means is disposed in the opposite axial orientation relative to said housing, defining thereon a second pair of stop surfaces disposed for individually abutting the end caps for defining a stroke of said predetermined magnitude;

said second pair of stop surfaces including third and fourth rigid abutment surfaces defined directly on said piston member, said third and fourth surfaces being axially spaced apart so that said elastomeric seal ring means is axially positioned therebetween, said third surface being positioned axially between said elastomeric seal ring means and one of said bumper-receiving grooves, said fourth surface being spaced axially outwardly of the piston member from the other bumper-receiving groove, and said fourth surface being spaced radially inwardly relative to said third surface.

* * * * *